US009589740B2

(12) United States Patent
Bertram et al.

(10) Patent No.: US 9,589,740 B2
(45) Date of Patent: Mar. 7, 2017

(54) SWITCH CONTACT WITH A WEIGHT-REDUCED CONTACT SPRING

(75) Inventors: Rolf Bertram, Oldenburg (DE); Martin Koepsell, Oldenburg (DE); Bruno Stenzel, Hatten (DE)

(73) Assignee: JOHNSON ELECTRIC OLDENBURG GMBH & CO. KG, Oldenburg (DE)

( * ) Notice: Subject to any disclaimer, the term of this patent is extended or adjusted under 35 U.S.C. 154(b) by 640 days.

(21) Appl. No.: 13/211,843

(22) Filed: Aug. 17, 2011

(65) Prior Publication Data

US 2011/0297520 A1 Dec. 8, 2011

Related U.S. Application Data

(60) Continuation of application No. 12/969,109, filed on Dec. 15, 2010, now Pat. No. 8,053,693, which is a division of application No. 11/901,627, filed on Sep. 18, 2007, now abandoned.

(30) Foreign Application Priority Data

Sep. 19, 2006 (DE) ..... 10 2006 043 795

(51) Int. Cl.

| | |
|---|---|
| ***H01H 1/06*** | (2006.01) |
| ***H01H 1/26*** | (2006.01) |
| ***H01H 1/10*** | (2006.01) |
| ***H01H 13/80*** | (2006.01) |

(52) U.S. Cl.

CPC ..... *H01H 1/26* (2013.01); *H01H 1/06* (2013.01); *H01H 1/10* (2013.01); *H01H 13/80* (2013.01); *H01H 2201/002* (2013.01)

(58) Field of Classification Search

CPC .. H01H 1/26; H01H 1/06; H01H 1/10; H01H 1/80; H01H 2201/002

USPC ..... 200/262, 240, 245–247, 250, 288, 407, 200/534, 535; 439/188, 862

See application file for complete search history.

(56) References Cited

U.S. PATENT DOCUMENTS

| | | | | |
|---|---|---|---|---|
| 4,053,729 | A | 10/1977 | Reiter | |
| 4,725,239 | A * | 2/1988 | Shichida | 439/668 |
| 4,978,310 | A * | 12/1990 | Shichida | 439/188 |
| 6,126,496 | A | 10/2000 | Shinozaki | |
| 2004/0224546 | A1 | 11/2004 | Hung | |
| 2006/0163047 | A1 | 7/2006 | Rehbein et al. | |

FOREIGN PATENT DOCUMENTS

| | | |
|---|---|---|
| DE | 1829459 | 4/1961 |
| DE | 2608236 | 10/1976 |

(Continued)

OTHER PUBLICATIONS

German Search Report with English Translation of relevant portions.

(Continued)

*Primary Examiner* — Felix O Figueroa

(74) *Attorney, Agent, or Firm* — Muncy, Geissler, Olds & Lowe, P.C.

(57) ABSTRACT

In an electrical switch, in particular an electrical microswitch, has at least one electrical contact designed as a hollow-shape section of a component of an electrically conducting material. In this electrical switch, the occurrence of vibrations with the introduction onto an opposing contact is prevented.

7 Claims, 2 Drawing Sheets

(56) References Cited

FOREIGN PATENT DOCUMENTS

| | | |
|---|---|---|
| DE | 7527477 | 2/1977 |
| DE | 3328360 | 2/1985 |
| EP | 1638119 | 3/2006 |
| FR | 2504311 | 4/1981 |

OTHER PUBLICATIONS

Schmelzle, M. "Grundlagen der Schaltgeratetecknik," 1974, pp. 186-190, ISBN 3-540-06075-8, Springer-Verlag, Berlin.
European Search Report with English translation of relevant portions.

* cited by examiner

SWITCH CONTACT WITH A WEIGHT-REDUCED CONTACT SPRING

CROSS REFERENCE TO RELATED APPLICATIONS

This application is a Continuation of co-pending application Ser. No. 12/969,109, filed on 15 Dec. 2010, which is a Divisional of application Ser. No. 11/901,627, now abandoned, filed on 18 Sep. 2007, and for which priority is claimed under 35 U.S.C. §120; and this application claims priority of Application No. 10 2006 043 795.0 filed in Germany on 19 Sep. 2006 under 35 U.S.C. §119, the entire contents of all of which are hereby incorporated by reference.

BACKGROUND OF THE INVENTION

1. Field of the Invention

The invention relates to an electrical switch, in particular an electrical microswitch, comprising at least one electrical contact.

2. The Prior Art

Electrical switches are used in electrical power circuits for the switching on and off of electrical loads. Often these kinds of power circuits are miniaturized, so that they can also be integrated into complex technical devices. In particular, miniaturized switches are used in vehicle construction, which switches control the various functions in a vehicle. Microswitches of this kind are found in e.g. door locks, bonnets, tailgates and in the interior of the vehicle.

Electrical switches, in particular microswitches, have at least one electrical contact that participates directly in the conduction of the electrical current. For this purpose, the contact consists of an electrically conducting material; it can be applied onto an opposing contact or to other electrically conducting sections in order to enable a flow of current.

In the prior art, contacts are used that are manufactured from solid material. In a further work operation, the solid material is attached to the contact support. A welding on of wire sections as a contact, or a riveting of contacts onto the support material is usual. Silver (and its alloys) or coating materials with silver and copper components find application as the solid material. Low hardness is a common factor for these materials.

The contacts of solid material have an increased mass, which causes problems because of the high dynamics of the switching process. A problem of a high mass is, e.g., that when it is applied onto an opposing contact, vibrations can occur that cause a temporary lift-off of the contact from the opposing contact. This is particularly the case if the contact is introduced to the opposing contact in an accelerated manner. With an impact of the contact of this kind, impulsive events can occur that cause multiple liftoff of the contact, as a result of which the current flow that is actually-desired is interrupted.

SUMMARY OF THE INVENTION

The object of the invention is to provide an electrical switch in which the occurrence of vibrations with the introduction onto an opposing contact is prevented.

This object is achieved according to the invention in that the contact is designed as a hollow-shape section of a component of an electrically conducting material.

For the switch according to the invention, the contact is not manufactured from a solid material. Rather, a structural shape exists as a hollow-shape section, as a result of which an external configuration is enabled in an advantageous manner as for a contact of a solid material. However, a significant reduction of the mass of the contact is achieved. This mass-reduced contact thus has available the same electrical contact surface as in the prior art, however in this case the occurrence of vibrations in the event of impact on an opposing contact is prevented. The contact according to the invention does not in fact have the mass necessary for the occurrence of impulses. The mass of the hollow-shape contact is in fact significantly reduced compared with a contact of solid material.

In a first embodiment of the invention, the contact has a hollow cylindrical shape which forms a contact surface on the surface of the cylinder that can be applied to variously designed opposing contacts. The opposing contact can preferably also have a cylindrical shape; here the two longitudinal axes of the cylinders can be aligned at an angle of about 90.degree. to one another. Opposing contact and contact then form an optimal point-shaped contact point (circular-shaped when taking into account flattening), which maintains its optimal shape even in the event of errors in the angle between the participating contacts.

The hollow shape can be designed from a plane material by forming of the same. The plane material can be an electrically conducting material that for example has been designed in a stamping process. For the switch according to the invention, no contact of solid material is to be externally applied to this plane material, but rather the contact designed as a hollow cylindrical shape can be formed e.g. by rolling of the material itself. In this manner, the manufacture of the electrical switch according to the invention is simplified.

The fixed contacts can similarly be formed by the forming process without additional solid material. According to the invention a work operation (the joining of the solid material to the support) is eliminated from the manufacture and the overall contact behavior is improved compared with the prior art. Soft material is not applied; the harder base material better withstands the mechanical loadings during the switching impact. No plastic deformations, or only minimal deformations, occur. In the switching process, relative movements of the contact surfaces can occur. Harder surfaces better withstand the frictional wear that results from these movements. If the contact surfaces are formed as recommended by a forming process (e.g. by rolling or stamping) a further increase in hardness ensues as a result of the forming process.

According to the prior art, contacts that conduct low currents (control currents) are provided with a noble metal coating, preferably gold (or its alloys). In the case of the solid material used, a larger surface is typically ennobled, as is necessary for the switching function, and is provided, e.g., with a noble metal coating.

According to another embodiment of the invention, a noble metal coating is selectively applied in the regions taking part in the switching function, as a result of which noble metal is saved. In the configuration according to the invention, the contact surfaces have a greater hardness than in the case of the solid material. The higher hardness enables a reduction of the coating thickness. For certain applications with this embodiment, the noble metal coating on one side can be eliminated, or reduced to an absolute minimum as pure transport protection, since the noble metal coating that is functionally necessary ensues as a result of material transfer from the opposing contact. The contact surfaces thus formed are better suited for the electrical and mechanical loads than contact surfaces of solid material.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
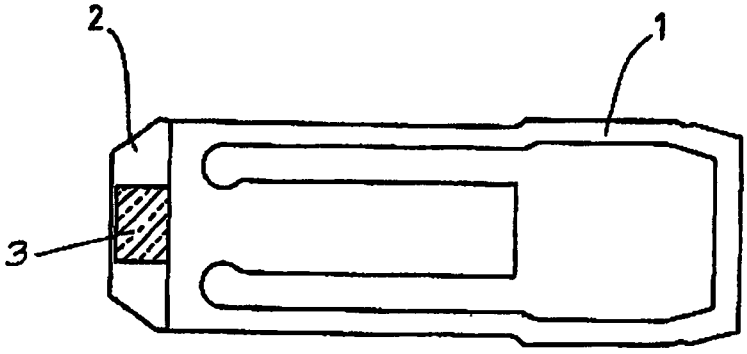
FIG. 1 shows a plan view of a component of an electrical switch with an electrical contact.

Referring now in detail to the drawings, FIG. 1 shows a stamped component 1 of an electrically conducting material. In one section of this stamped component 1 an electrical contact 2 is designed. Contact 2 is integrally connected with the other regions of stamped component 1.

Figure 2:
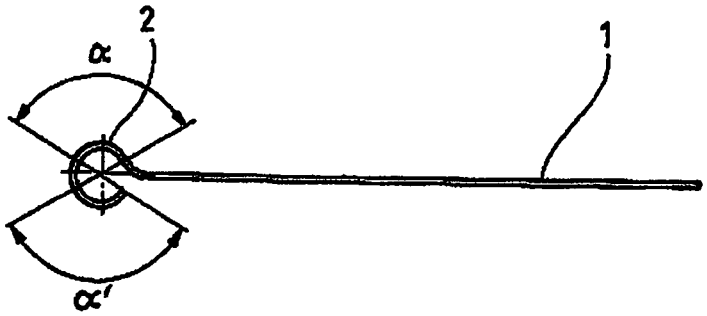
FIG. 2 shows a side view of a component according to FIG. 1.

FIG. 2 shows that contact 2 has a hollow cylindrical shape. Contact 2 is designed by rolling of the material of stamped component 1 arranged in the front region of stamped component 1. The angles .alpha. and .alpha.' indicate the surface regions of contact 2 in which contact surfaces 3 of contact 2 are located. With these regions, contact 2 can be applied to an opposing contact that is not further represented.

Figure 3:
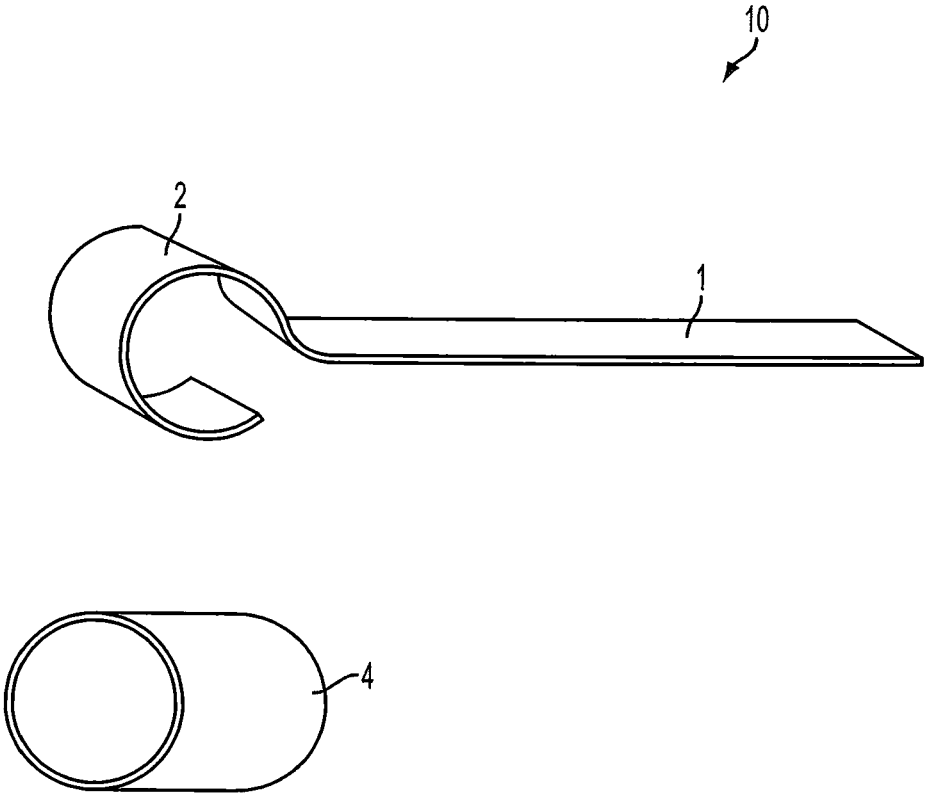
FIG. 3 shows a perspective view of the switch having the component of FIG. 1.

FIG. 3 shows a switch 10 using the component 1 and contact 2 described above in conjunction with opposing cylindrical contact 4.

Stamped component 1 consists for example of brass, which has a thickness of approximately 0.5 mm. In the region of contact surface 3, a noble metal coating is applied to the brass.

Accordingly, while only a few embodiments of the present invention have been shown and described, it is obvious that many changes and modifications may be made thereunto without departing from the spirit and scope of the invention.

What is claimed is:

1. An electrical microswitch, comprising:

a component of an electrically conducting material;

said component including a planar section and a cylindrical hollow shape section, said planar section and said cylindrical hollow shape section being monolithic with each other, with one end of said planar section extending into said cylindrical hollow shape section, said planar section having planar top and bottom main surfaces;

said hollow-shape section including at least one electrical contact and having a reduced mass, a center of said cylindrical hollow-shape section lying in an extension of a plane parallel to the planar top and bottom main surfaces of the planar portion, said plane extending within said planar portion;

at least one opposing electrical contact, said at least one electrical contact and said at least one opposing electrical contact coming into contact to make an electrical connection and allowing conduction of electrical current only upon actuation of said microswitch;

wherein occurrence of vibration and impulsive events causing liftoff of the at least one electrical contact is prevented when contacting said opposing electrical contact as a result of reduced mass of said hollow shape section.

2. The switch according to claim 1, wherein the hollow shape is created from a plane material by forming the plane material.

3. The switch according to claim 1, wherein the at least one electrical contact has at least one contact surface, onto which a noble metal coating is selectively introduced.

4. The switch according to claim 3, wherein the noble metal coating on the contact surface is only applied to one side of the contact surface.

5. The switch according to claim 1, wherein the component is a stamped component, and wherein the at least one electrical contact is integrally formed with said stamped component.

6. The switch according to claim 1, wherein the at least one electrical contact is arranged within a range of angles on said hollow-shape section.

7. An electrical microswitch, comprising:

a stamped component of an electrically conducting material;

said stamped component including a planar section and a cylindrical hollow shape section, said planar section and said cylindrical hollow shape section being monolithic with each other, with one end of said planar section extending into said cylindrical hollow shape section, said planar section having planar top and bottom main surfaces, a center of said hollow-shape section lies in an extension of a plane parallel to the planar top and bottom main surfaces of the planar portion, said plane extending within said planar portion;

said cylindrical hollow-shape section including at least one electrical contact created from a plane material by integrally forming the plane material with the stamped component, the at least one electrical contact being arranged within a range of angles on said cylindrical hollow-shape section;

the at least one electrical contact having at least one contact surface onto which a noble metal coating is selectively introduced only on one side of the contact surface;

at least one opposing electrical contact, said at least one electrical contact and said at least one opposing electrical contact coming into contact to make an electrical connection and allowing conduction of electrical current only upon actuation of said microswitch;

wherein occurrence of vibration of the at least one electrical contact is prevented when contacting said opposing electrical contact as a result of reduced mass of said hollow shape section.

* * * * *